United States Patent [19]

Palchetti et al.

[11] Patent Number: 4,741,771

[45] Date of Patent: May 3, 1988

[54] PROCESS FOR REDUCTION OF IMPURITIES CONTENT OF HOT METAL

[75] Inventors: Maurizio Palchetti; Santi Palella; Adolfo Crisafulli, all of Rome, Italy

[73] Assignee: Centro Sperimentale Metallurgico S.P.A., Rome, Italy

[21] Appl. No.: 939,403

[22] Filed: Dec. 8, 1986

[30] Foreign Application Priority Data

Dec. 6, 1985 [IT] Italy ..... 48889 A/85

[51] Int. Cl.[4] ..... C21C 7/00

[52] U.S. Cl. ..... 75/57; 75/53

[58] Field of Search ..... 75/53, 57

[56] References Cited

U.S. PATENT DOCUMENTS 2,049,004 7/1936 Flannery ..... 75/57

3,396,010 8/1968 Gould ..... 75/53

3,929,464 12/1975 Todd ..... 75/53

3,944,195 3/1976 Buell ..... 75/53

3,998,625 12/1976 Koros ..... 75/53

*Primary Examiner*—Peter D. Rosenberg

*Attorney, Agent, or Firm*—Young & Thompson

[57] ABSTRACT

A continuous process for the reduction of impurities in hot metal from a blast furnace, in which the hot metal is tapped into runners and then discharged into a torpedo car. The silicon and phosphorus contents are measured; and if silicon is greater than 0.25% by weight, then a silicon reduction agent is added to the tapped metal at the upstream end of the runners. An appropriate amount of phosphorus reduction agent is added to the hot metal at the downstream end of the runners as the hot metal falls into the torpedo car.

7 Claims, 1 Drawing Sheet

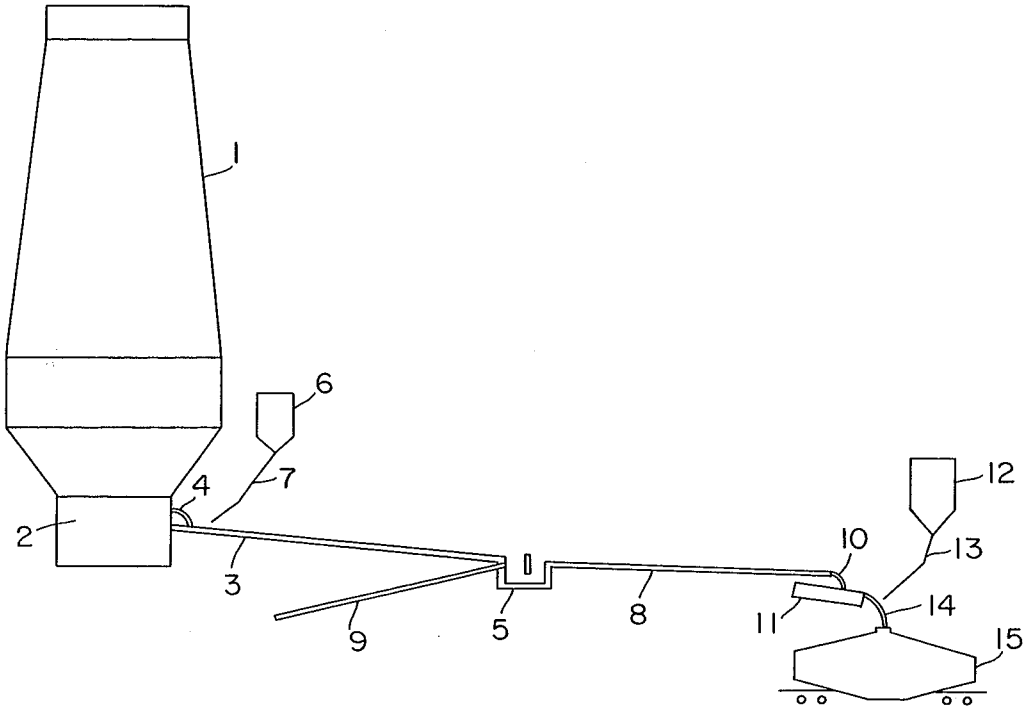
1
2
3
4
5
6
7
8
9
10
11
12
13
14
15

PROCESS FOR REDUCTION OF IMPURITIES CONTENT OF HOT METAL

DESCRIPTION

This invention concerns a process for reduction in the quantity of impurities in hot metal. More precisely it concerns a continuous dephosphorizing process performed while the hot metal is being transferred from the blast furnace to the torpedo car.

Modern technology calls for steels that are tailor-made for given applications and, especially for steels with a low or very low impurities content, particularly phosphorus. However, the converter (BOF or the like) is increasingly coming to have essentially the role of a decarburizing reactor, and must operate under conditions that are becoming ever more standardized.

It is evident therefore that the hot metal, which is the main item in the converter charge, must have a controlled analysis and a phosphorus content that is below a given, specific value. It can be said, for instance, that the iron from a blast furnace charged with a carefully selected burden has a phosphorus content of around 600–750 parts per million (ppm), while to obtain "clean" steels, namely those with a phosphorus content of less than 150 ppm, it is convenient to start with an iron that has no more than about 400 ppm of phosphorus.

Of the various methods proposed to meet this requirement, only two, both Japanese, have found practical application, and both provide for injection of an addition agent into the hot metal in the torpedo car. In one of the methods the addition consists essentially of a mixture of iron oxide and lime, while in the other it is mainly a mixture of iron oxide and sodium carbonate. This latter method results in the formation of an extremely reactive slag containing sodium oxide which, among other things, causes heavy wear of the torpedo car refractory lining. Consequently, only the method involving the use of lime has found industrial application, despite the fact that it is less efficient as regards dephosphorization. Yet even here, more general adoption of the method is hindered by a number of drawbacks, the most serious being: lengthy treatment times, entailing the need to increase the number of torpedo cars in circulation high cost of plant because the injection must be performed beneath a considerable head of hot metal, so the whole plant is at high pressure (about 10 atmospheres)

production of a large amount of foamy slag which spills out of the mouth of the torpedo car.

Hence, the method not only calls for a greater number of torpedo cars, it also leads to spillage of slag from the cars, so provision must be made, too, for means for collecting and disposing of the slag, plus machinery to clean the mouth of the cars which must thus be serviced more frequently. All of this, of course, increases costs very considerably. Moreover, the method may not even be applicable to some existing blast furnaces where, perhaps, the railway network cannot be expanded sufficiently to handle the big increase in the number of torpedo cars in operation.

Thus a treatment which, for various reasons, appears to be highly desirable, may in fact be relatively unattractive.

The present invention is designed to overcome these drawbacks, the hot metal treatment method involved being simple and cheap, while not requiring any further treatment or processing.

The invention stems from the observation that though hot metal flows down the main runner from the blast furnace fairly slowly and without turbulence, the fall from the taphole to the main runner and then from this level into the torpedo car causes quite intense mixing which can be used to ensure intimate contact between the hot metal and, for instance, an addition agent, so guaranteeing reasonably efficient treatment. Dephosphorization can thus be performed easily in this way; however, it must be pointed out that this is not possible if the quantity of silicon in the hot metal exceeds 0.25% by weight.

This invention is characterized, therefore, by the combination of the following operations performed sequentially:

(a) measurement of the silicon and phosphorus contents—by known methods—of the hot metal as it is tapped from the blast furnace (b) if the silicon content is greater than 0.25% by weight, addition of a silicon reduction agent into the main runner as close as possible to the stream leaving the taphole (c) addition of a phosphorus reduction agent to the deslagged hot metal as the stream falls into the torpedo car.

The addition agents for reduction of silicon and phosphorus are fed continuously, of course, during the whole of the tapping operation, the quantities used being in keeping with the effect it is wished to obtain. The addition agents consist essentially of a mixture of iron oxide and calcium oxide. More precisely, the addition agent for silicon reduction contains between 80 and 100 percent iron oxides, the remainder consisting essentially of calcium oxide. This is fed to the hot metal in the main runner at a rate preferably between 10 and 50 kg/ton.

The dephosphorizing agent contains between 40 and 70 percent iron oxides, by weight and between 30 and 60 percent calcium oxide, while it can also contain up to 20 percent of fluorspar and calcium chloride. This agent is generally added at the point where the hot metal falls into the torpedo car, the quantity ranging between 30 and 70 kg/ton hot metal.

As already mentioned, the quantity of agent needed for each silicon and/or phosphorus reduction operation is calculated basically as a function of the quantity of element to be eliminated and subordinately as a function also of the general characteristics of the plant which influence turbulence of the hot metal, such as, for instance, the height of the hot metal falls, the cross-section of the main runner, and of the runner, etc.

The addition agents can be allowed to fall simply into the hot metal from feed belts, feed screws or the like. However, it has been noted that owing to the moisture content of the calcium oxide, feeders operating basically by gravity may block up or at least not feed the agent regularly. Consequently, it is also possible to use pneumatic devices for conveying and introducing the addition agents; however, high pressures can be avoided.

The process for the continuous treatment of hot metal as per this invention is therefore very simple and it utilizes technical devices that are also simple and cheap, permitting operations to proceed without major and often impossible action having to be taken on the general plant layout and management.

The invention will now be described in greater detail by reference to an embodiment which is given purely for the purpose of exemplification and is in no way limiting as regards the invention or claims thereto. The explanation is facilitated by reference to a schematic layout of a possible plant.

Hot metal tapped from the hearth 2 of blast furnace 1 falls as a stream 4 into main runner 3, which is broad, deep relatively short and slopes slightly downwards, to terminate in a slag skimmer or pocket 5, to remove slag from the metal. The slag is removed from pocket 5 by runner 9, while the hot metal proceeds down runner 8 which has a smaller cross-section than main runner 3. At the end of the runner, the hot metal falls as a stream 10 into a swivel device 11 which directs the hot metal to a torpedo car 15 at one end or other of device 11. In the trials we have run, one of the tapholes of a blast furnace producing 9400 t hot metal/day was equipped as indicated in the sketch.

It should be observed that hot metal is cast more or less continuously from the blast-furnace used in the trials, so there are no great variations in composition during tapping operations from a single taphole though there are, of course, changes from one tapping to the next.

In practice, the composition of the hot metal is determined at the start of tapping and, consequently, the amount of silicon reduction agent to be added is established. The addition agent is fed from bin 6 via conveyance device 7 into main runner 3 near the stream 4. The amount of dephosphorizing agent is similarly determined and this is fed from bin 12 via conveyance device 13 into stream 14.

In one of the trials the hot metal silicon and phosphorus contents ranged from 0.40 to 0.20% and from 0.070 to 0.065% (by weight), respectively. The following tables indicate the average silicon and phosphorus reductions that can be obtained with different quantities of addition agents.

TABLE 1

| | Amount of silicon reduction agent (kg/t hot metal) | | |
|---|---|---|---|
| | 12 | 25 | 45 |
| ΔSi | 0.11 | 0.15 | 0.18 |

TABLE 2

| | Amount of phosphorus reduction agent (kg/t hot metal) | | | |
|---|---|---|---|---|
| | 35 | 45 | 50 | 65 |
| ΔP | 0.028 | 0.033 | 0.043 | 0.053 |

Hot metal containing 0.28% Si by weight and 0.070% P by weight was treated with a mixture containing 10% CaO and 90% $Fe_2O_3$ as silicon reduction agent, the amount used being 25 kg/t hot metal and the addition being made in the main trough near the stream coming from the taphole and with a mixture containing 40% CaO, 55% $Fe_2O_3$ and 5% $CaCl_2+CaF_2$ as phosphorus reduction agent, the amount used being 50 kg/t hot metal and the addition being made to the stream entering the torpedo car.

After the addition to the main runner the silicon content decreased to 0.16% while analysis of the hot metal in the torpedo car indicated 0.028% phosphorus. At the entrance to the steelworks the phosphorus content of the hot metal had further decreased to 0.024%, indicating a good level of mixing of the addition agent which continued to react even in the full torpedo car.

It is thus evident how in a very simple, cheap manner it is possible to obtain large, carefully controlled reductions in silicon and phosphorus, hitherto attainable only by the quite costly measures indicated at the beginning of this description, which cannot even be applied in some existing steelworks.

The materials employed, which are of course known for similar uses, are very economical and readily available in large quantities in steelworks; for instance, the iron oxides can consist of mill scale, red convertor fumes or other similar materials.

We claim:

1. A continuous process for reduction of the impurities content of hot metal containing phosphorus and more than 0.25% by weight silicon, tapped from the taphole of a blast furnace into the upstream end of runner means and discharged from the downstream end of said runner means into a receptacle, comprising adding a silicon reduction agent to the hot metal at the upstream end of said runner means, deslagging the hot metal, and adding a phosphorus reduction agent to the hot metal at the downstream end of said runner means as the hot metal falls into said receptacle.

2. Process as per claim 1, in which the silicon and phosphorus reduction agents are fed continuously, during substantially the whole tapping operation.

3. Process as per claim 1, in which the addition agents for silicon and phosphorus reduction include iron oxides and calcium oxide.

4. Process as per claim 3, in which the addition agent for silicon reduction contains between 80 and 100 percent by weight of iron oxides, balance essentially calcium oxide.

5. Process as per claim 3, in which the addition agent for phosphorus reduction contains between 40 and 70 percent by weight of iron oxides, between 30 and 60 percent by weight of calcium oxides, and up to 20 percent by weight of calcium fluoride plus calcium chloride.

6. Process as per claim 4, in which said addition agent for silicon reduction is fed at a rate of between 10 and 50 kg per ton of hot metal.

7. Process as per claim 5, in which said addition agent for phosphorus reduction is fed to the hot metal falling into the torpedo car at a rate of between 30 and 70 kg per ton of said hot metal.

* * * * *